US006545641B2

(12) United States Patent
Ghosh et al.

(10) Patent No.: US 6,545,641 B2
(45) Date of Patent: Apr. 8, 2003

(54) PATCH ANTENNA FOR THE MICROWAVE RANGE

(75) Inventors: Indra Ghosh, Köln (DE); Rebekka Porath, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/973,316

(22) Filed: Oct. 9, 2001

(65) Prior Publication Data

US 2002/0047804 A1 Apr. 25, 2002

(30) Foreign Application Priority Data

Oct. 9, 2000 (DE) ..... 100 49 843

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 6,040,806 A * 3/2000 Kushihi et al. ..... 343/853
6,111,544 A * 8/2000 Dakeya et al. ..... 343/700 MS
6,281,848 B1 * 8/2001 Nagumo et al. ..... 343/700 MS

FOREIGN PATENT DOCUMENTS

WO WO 9818177 4/1998 ..... H01Q/9/04

* cited by examiner

*Primary Examiner*—Don Wong
*Assistant Examiner*—James Clinger
(74) *Attorney, Agent, or Firm*—Jack D. Slobod

(57) ABSTRACT

A patch antenna with at least one patch resonator (10, 20) for the microwave range is described, which antenna is in particular suitable for an embodiment as a multilayer antenna with short-circuit conductor (14, 24) and for SMD mounting on a printed circuit board. The antenna furthermore has a bandwidth sufficient for use in mobile telecommunication also when substrates (11, 21) having the same dielectric or permeability value are used. This is achieved essentially in that the feed terminal comprises at least a first metallization piece (17) which extends on a first side face (112) of the resonator between the ground metallization (12) and the pattern (13) of metal patches, while the input impedance of the antenna is adjustable through a change in the dimensions of this metallization piece. A special embodiment of the antenna comprises a resonant coupling by means of a line resonator in the form of a microstrip line resonator (10') or a printed wire resonator (19, 29), such that the bandwidth of the antenna can be further increased and the antenna is also suitable for being provided with a short-circuit conductor and for SMD mounting.

20 Claims, 4 Drawing Sheets

PATCH ANTENNA FOR THE MICROWAVE RANGE

The invention relates to a patch antenna, in particular for the microwave range, with at least one patch resonator with a metal patch pattern and a ground metallization as well as a feed terminal for the supply of electromagnetic energy.

Electromagnetic waves in the microwave region are used in mobile telecommunication for the transmission of information. Examples of this are the GSM mobile telephone standard in the frequency range from 890 to 960 MHz (GSM900) and from 1710 to 1880 MHz (GSM1800 or DCS), furthermore the UMTS band (1970 to 2170 MHz), the DECT standard for cordless telephones in the frequency range from 1880 to 1900 MHz, and the new Bluetooth standard in the frequency range from 2400 to 2480 MHz, which serves to exchange data between, for example, mobile telephones and other electronic devices such as, for example, computers, other mobile telephones, etc.

The market shows a strong trend towards miniaturization of these devices. This results in the wish also to reduce the components for the mobile communication, i.e. the electronic components, in size. The antenna types used at present in mobile telephones, which are usually wire antennas, have substantial disadvantages in this respect, because they are comparatively large. They project from the mobile telephones, may readily break off, may come into undesirable eye contact with the user, and also stand in the way of an aesthetic design. Increasingly, moreover, an undesirable microwave irradiation of the user by the mobile telephone has become a subject of public discussion. A major portion of the emitted radiation power may be absorbed in the user's head in the case of wire antennas which project from the mobile telephone.

A further problem arises from the fact that surface mounting (with SMDs or surface mounted devices), i.e. the planar soldering of electronic components onto a PCB or printed circuit board by means of a wave soldering bath or a reflow soldering process, has become common practice in the technical realization of modern digital electronic devices. The antennas used until now, however, are not suitable for this mounting technology, because they often can only be provided on the printed circuit board of the mobile telephone by means of special supports, while also the supply of electromagnetic power is only possible by means of special supply/support members such as pins or the like. This causes undesirable mounting steps, quality problems, and additional expense.

The antennas used nowadays in mobile telephones radiate electromagnetic energy upon the creation of an electromagnetic resonance. This requires that the length of the antenna should at least be equal to one fourth the wavelength of the transmitted radiation. With air as the dielectric ($\in_r=1$), this results in a necessary antenna length of 75 mm for a frequency of 1 GHz.

To minimize the size of the antenna for a given wavelength of the emitted radiation, a dielectric with a dielectric constant $\in_r>1$ may be used as a basic building block for the antenna. This leads to a reduction in the wavelength of the radiation in the dielectric by a factor $1/\subseteq\in_r$,. An antenna designed on the basis of such a dielectric will accordingly have its size reduced by this same factor.

The so-called patch pattern antenna or patch antenna as described, for example, in WO 98/18177, is an antenna type in which the miniaturization by means of the dielectric constant $\in_r$ can be utilized. It consists of a solid block of dielectric material with $\in_r>1$. The height of the block here typically is smaller than its length and width by a factor 3 to 10. The block is provided with a pattern of metal patches over the whole or part of one surface, and with a ground metallization on the other surface. Between these electrodes, electromagnetic resonances are generated whose frequencies depend on the dimensions of the electrodes and the value of the dielectric constant $\in_r$ of the block. The values of the individual resonance frequencies decrease with increasing lateral dimensions of the antenna and—as described above—with increasing values of the dielectric constant $\in_r$. To achieve a high degree of miniaturization of the antenna, therefore, $\in_r$ will be designed to be high, and the mode having the lowest frequency will be chosen from the resonance spectrum. This mode is denoted the base or fundamental mode.

A step towards further miniaturization consists in the additional insertion of a conductive connection (short-circuit conductor) in the dielectric between the two electrodes. Given a same resonance frequency, it is usually possible to reduce the size of the antenna by a factor 4 thereby.

A problem in these patch antennas (with or without short-circuit conductor) is, however, that the bandwidths amount to only a few MHz for the resonance frequencies lying within the frequency range of the GSM standard. In addition, the bandwidth decreases as the dielectric constant $\in_r$ of the dielectric material increases. The bandwidth required for the GSM standard by contrast is approximately 70 MHz. Conventional patch antennas are accordingly unsuitable for such broadband applications.

Several patch pattern resonators with or without short-circuit conductors may be vertically stacked so as to realize greater bandwidths also with patch antennas. This configuration is denoted a multilayer patch antenna. The number of fundamental modes of the multilayer patch antenna is equal to the number of constituent patch resonators. If the frequency distance between the fundamental modes is smaller than the bandwidth thereof, the total bandwidth of the antenna can thus be increased.

This type of antenna, however, also has two major disadvantages. On the one hand, substrate materials with dielectric constant values which can be easily distinguished must be used (for example $\in_{r1}=2.2$ and $\in_{r2}=1.07$) for the individual patch resonators so as to achieve a suitable frequency distance of the resonators. This increases the manufacturing expenditure.

On the other hand, a coax cable was found to be the only means for supplying the antenna with electromagnetic power and for adjusting the input impedance of the antenna over a limited range such that only small reflections occur at the feed structure in the case of multilayer patch antennas with short-circuit conductors. This type of feedline, however, hampers an SMD integration on a printed circuit board (PCB) of a mobile telephone, because suitable pins are to be provided for the supply of the electromagnetic power on the PCB which are to be passed through the metallization from below, so that the antenna cannot be soldered on the PCB together with the other components by means of surface mounting (SMD technology).

It is accordingly an object of the invention to provide a patch antenna of the kind mentioned in the opening paragraph which is suitable for surface mounting (SMD) on a printed circuit board, also with a short-circuit conductor.

It is also an object of the invention to provide a patch antenna which with small dimensions provides a bandwidth satisfactory for the applications mentioned above, also without the use of dielectrics which have different dielectric constants.

Furthermore, the invention is to provide a patch antenna whose input impedance can be adjusted such that the power supplied to the antenna is not reflected at the antenna but is substantially completely radiated without the antenna having to comprise a coaxial feed line.

Finally, a patch antenna is to be provided which has as a feature a particularly great bandwidth.

According to claim 1, these objects are achieved by means of a patch antenna of the kind mentioned in the opening paragraph which is characterized in that the feed terminal comprises at least a first metallization piece which extends over a first side face of the resonator between the ground metallization and the pattern of metal patches, while the input impedance of the antenna is determined by the dimensions of said metallization piece.

A particular advantage of this solution is that an optimum attunement of the input impedance to a concrete constructional situation is possible in a simple manner (for example through laser trimming), so that no reflections occur at the antenna and the supplied electromagnetic power is substantially fully radiated. This antenna may at the same time be fitted with a short-circuit conductor for reducing its dimensions.

A further solution to the problems mentioned above is achieved with a patch antenna of the kind mentioned in the opening paragraph according to claim 4, which is characterized by a line resonator which is formed by a line provided on at least a substrate and which serves for a resonant coupling of the electromagnetic energy supplied to the feed terminal into the at least one patch resonator.

A particular advantage of this solution is that this resonant coupling mechanism does not detract from the formation of the patch pattern resonances, and the bandwidth of the antenna can be further increased to a substantial degree through the addition of a further resonance. In addition, this antenna is also suitable for SMD mounting and for the provision of a short-circuit conductor.

The dependent claims relate to advantageous further embodiments of the invention.

The embodiment of claim 2 enables a particularly simple surface mounting of the antenna by the SMD technology because the second metallization piece can be directly soldered together with the ground metallization onto a printed circuit board.

The embodiment of claim 3 has the particular advantage that the bandwidth is further increased through the two resonators, also when substrates of the same dielectric or permeability value are used, and that it is also suitable for a construction with a short-circuit conductor.

The embodiment of claim 5 has the particular advantage that the coupling strength between the line resonator and the patch resonator can be adjusted by means of the dimensions of the end portion. A farther advantage of this embodiment and of that defined in claim 7 is that the frequency of the resonant coupling can be adjusted through suitable definitions of the lengths of said lines.

The embodiment of claim 6 renders possible an adaptation of the coupling strength between the feed terminal and the line resonator.

The bandwidth of the antenna can be further increased with the embodiment of claim 8, while the embodiments of claims 9 and 10 essentially enable a further miniaturization of the antenna.

The antenna according to the invention, finally, may be used to particular advantage on a printed circuit board as defined in claim 11 and in a mobile telecommunication device as defined in claim 12.

Further particulars, characteristics, and advantages of the invention will become apparent from the following description of preferred embodiments, which is given with reference to the drawing in which:

FIG. 1 diagrammatically shows a first embodiment of the antenna;

FIG. 2 is a reflection diagram of this antenna;

FIG. 3 diagrammatically shows a second embodiment of the antenna;

FIG. 4 is a reflection diagram of this antenna; and

FIG. 5 diagrammatically shows a third embodiment of the antenna.

The patch antennas shown in FIGS. 1, 3, and 5 are composed of several layers which are each depicted separated from one another in perpendicular direction and which in the assembled state form a patch antenna with two individual resonators formed by patterns of patches. Each layer is formed by a ceramic substrate in the form of a substantially rectangular block whose height is generally smaller than its length or width by a factor 3 to 10. The following description is based on this situation, and the surfaces of the substrate shown as the top and the bottom in the drawings of the Figure will be denoted the upper surface and the lower surface, while the smaller, vertical surfaces will be denoted the side faces.

Alternatively, however, it is quite possible to choose other geometric shapes such as, for example, a cylindrical shape instead of a block shape for the substrate, on which then a corresponding resonant conductor track structure with, for example, a spiraling shape is provided.

The substrates may be manufactured, for example, through embedding of a ceramic powder in a polymer matrix and have a dielectric constant value of $\in_r>1$ and/or a permeability value of $\mu_r>1$.

The first embodiment of the antenna shown in FIG. 1 comprises two layers which in the assembled state each form a lower, first and an upper, second patch pattern resonator 10 and 20, respectively. The first resonator 10 comprises a first substrate 11 on whose lower surface a ground metallization 12 is provided. The upper surface of the first substrate 11 supports a first pattern of metal patches 13 which extends over a major portion of the upper surface, while only edge portions 111 of this upper surface remain free. A first portion 14 of a short-circuit conductor extends between the ground metallization 12 and the first pattern of patches 13.

About halfway the length of a first side face 112 of the first substrate 11 there is a feed terminal 15, 17, which is formed by a first metallization piece at this side face in the form of a strip conductor 17 extending in a direction towards the upper surface of the substrate and by a second metallization piece 15 which lies on the lower surface in a region 16 where the ground metallization 12 has a recess. The feed terminal is accordingly insulated from the ground metallization 12.

The second resonator 20 of patterned patches is formed by a second substrate 21 on whose upper surface a second pattern of metal patches 23 is provided which extends over the entire upper surface. Furthermore, a second portion 24 of the short-circuit conductor is present in the second substrate 21. When the antenna is assembled through joining together of the two resonators in the direction of the arrow A, the second portion 24 will form a continuation of the first portion 14, whereby the short-circuit conductor is created.

An essential feature of this first embodiment of the antenna is based on the surprising recognition that in contrast to the view prevailing until now coupling of electromagnetic energy into a patch antenna is possible also with a non-coaxial feed terminal 15, 17 of the kind described, i.e. also when this antenna is provided with a short-circuit conductor whereby the dimensions of the antenna can be further reduced.

It was furthermore found that the input impedance of the antenna can be adjusted through a suitable choice of the height and width of the strip conductor 17, so that an optimization can be achieved as regards low reflections of the antenna, so that by far the major portion of the electromagnetic power supplied to the antenna is indeed radiated.

The feed terminal or strip conductor 17 may be composed of several metal pieces of variable widths.

Since the second metallization piece 15 of the feed terminal is present at the lower surface of the first substrate 11, and no pins or similar items are required as in the case of a feed terminal formed by a coax cable, the antenna can be mounted together with other components on a printed circuit board in a conventional surface mounting process (SMD). Furthermore, the ground metallization 12 can also be soldered to a corresponding ground connection on the printed circuit board in this manner.

A further advantage of this embodiment is that the same material can be used for the first and the second substrate 11, 12, which material need not have different dielectric constants for achieving a sufficient bandwidth of the antenna, as was the case in prior art patch antennas with short-circuit conductors.

According to the invention, the frequency bandwidth required for the applications mentioned above is achieved inter alia in that the antenna is composed of (at least) two layers, i.e. two resonators 10, 20 of patch patterns whose individual resonances in an operational mode are somewhat different owing to the different sizes of the first and second patterns 13, 23 of patches.

Alternatively, the patch patterns may be identical. In this case the coupling of the two resonators achieves a splitting-up of the nominally identical resonance frequencies, and thus an increase in the frequency bandwidth.

In a preferred realization of this antenna, the dimensions of the substrates 11, 21 are each approximately 19.4×10.9×2.0 $mm^3$. The dielectric properties of the material used for the substrates are approximately as follows: $\in_r$=18.55, tanδ=$1.17\times10^{-4}$. This corresponds to the high-frequency properties of a commercially available NP0-K17 ceramic ($Ca_{0.05}Mg_{0.95}TiO_3$ ceramic). The conductivity of the metallizations (silver paste) is approximately $\sigma=3.0\times10^7$ S/m. The lowermost, first patch pattern 13 has dimensions of approximately 17.0×8.5 mm, and the uppermost, second patch pattern 23 covers the surface of the second substrate 21 substantially fully. The ground metallization 12 covers the lower surface of the first substrate 11 substantially fully, except for the recess 16 which accommodates the second metallization piece 15. The lateral strip conductor 17 is approximately 1.8 mm wide and approximately 2.0 mm high. It is continued on the lower surface of the first substrate 11 in the form of a second metallization piece 15 with a length of approximately 0.5 mm. The short-circuit conductor 14, 24 has a diameter of approximately 0.5 mm, a distance in both lateral directions to the two corners of the substrates 11, 31 of 3.5 mm each time, and extends inside the two substrates between the metallizations.

Figure 1:
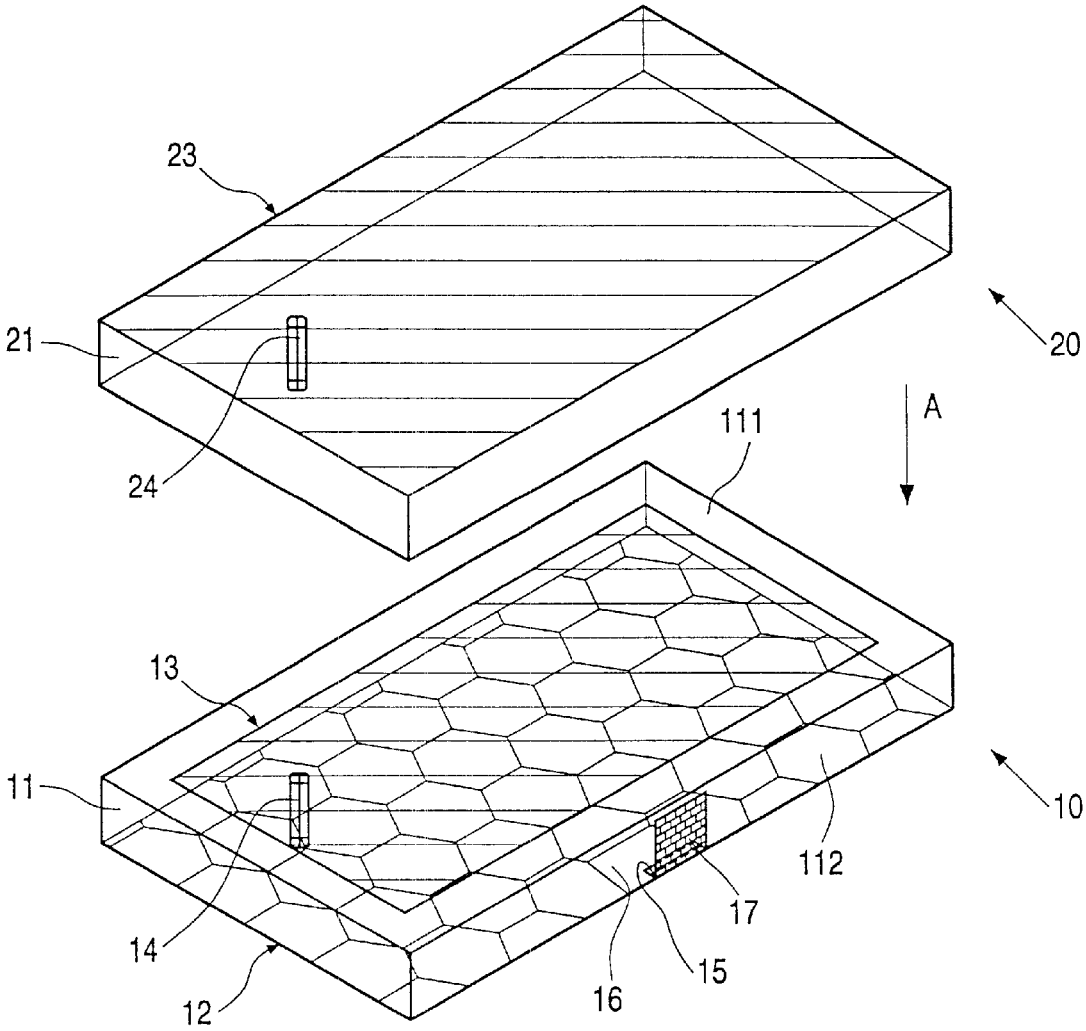
Figure 2:
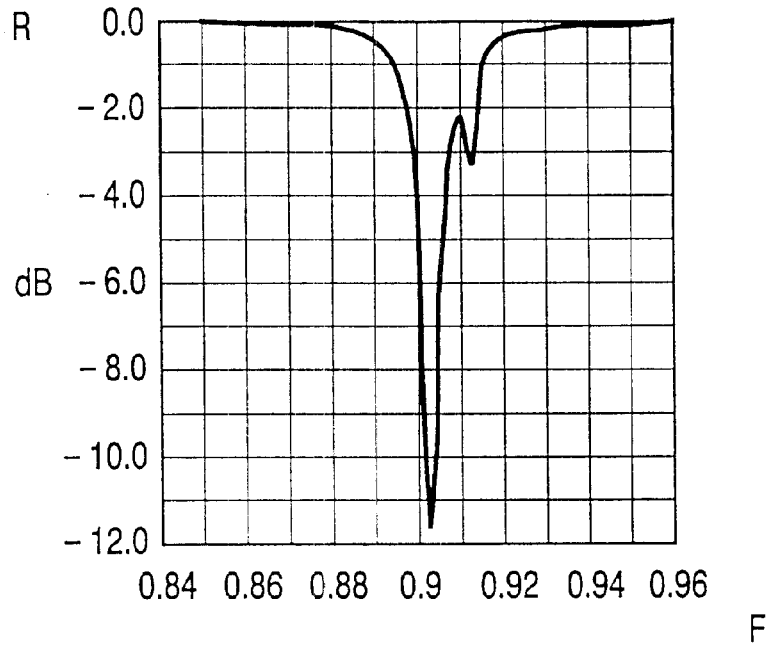
FIG. 2 shows a reflection diagram for this antenna, i.e. the ratio R [dB] between the power reflected at the antenna to the power supplied to the antenna as a function of the frequency F [GHz]. The individual resonances of the two layers (patch resonators) are clearly discernible as contributing to a widening of the total bandwidth of the patch antenna.

The microstrip resonator 10' comprises a first substrate 11' which is coated with a ground metallization 12' on its surface shown as the upper surface in the drawing. A meandering microstrip conductor 18' is provided on the lower surface of this first layer, which conductor starts at a feed terminal 15' and is guided in upward direction at a side face of the substrate 11'. A short-circuit between the ground metallization 12' and the microstrip conductor 18' is to be avoided for this upward track. This may be achieved, for example, through a suitable shortening of the ground metallization 12' at the relevant side face of the first substrate 11'.

The feed terminal 15' grips around the start of the microstrip conductor 18' in a U-shape, a gap being present between the two by means of whose dimension the coupling strength between the two is adjusted. The resonance frequency of this microstrip resonator 10' is determined substantially by the length of the microstrip conductor 18', as is usual. A first portion 14' of a short-circuit conductor may also be present in the first layer.

The first patch resonator 20 is formed by a second substrate 21 which supports a first pattern of metal patches 23 on its upper surface, a surrounding edge region 211 of the upper surface remaining free. At a side face 213 of the substrate 21 there is an end portion 28 which in the assembled state of the antenna continues the microstrip conductor 18' and terminates the latter. The coupling strength to the first patch resonator 20 can be set by means of the dimensions of this end portion. A second portion 24 of the short-circuit conductor is furthermore present in the first patch resonator 20.

The second patch resonator 30 is formed by a third substrate 31 which supports a second pattern of metal patches 33 on its upper surface, while again a circumferential edge portion 311 of the upper surface remains free. A third portion 34 of the short-circuit conductor extends through the second patch resonator 20. The first and the second pattern of metal patches 23, 33 may have different dimensions on the substrates 21 and 31, as was the case in the first embodiment.

When these three layers are joined together in the direction of the arrows A, a multilayer patch antenna with resonant coupling of the electromagnetic energy is created which in comparison with a multilayer patch antenna without resonant coupling achieves a further increase in the bandwidth.

This configuration is based on the surprising recognition that the resonance frequencies of the fundamental modes of the individual patch resonators are interfered with to a negligible degree only by a resonant coupling by means of a microstrip resonator 10' of the kind described above. This is true in particular also when a short-circuit conductor 14', 24, 34 is used. The ground metallization 12' constitutes at the same time the ground for the first patch resonator 20 and the microstrip resonator 10'. The generation of the individual patch pattern resonances in addition increases the bandwidth of a corresponding multilayer patch antenna.

The electromagnetic coupling of the patch resonators 10, 20 to the microstrip resonator 10' takes place via the microstrip conductor 18', 28 extending in upward direction along a side face 213 of the second substrate 21, such that the coupling strength and the bandwidth of the antenna can be defined or modified by means of the height and width of in particular the end portion 28 on the first patch resonator 20.

The resonance frequency of the microstrip resonator 10' can be adjusted by means of the length of the microstrip conductor 18', 28 in a known manner.

Finally, the coupling between the feed terminal 15' and the microstrip conductor 18', 28 can be adjusted through a suitable choice of the gap width between the two.

This second embodiment again has the advantage that it can be provided together with other components on a printed circuit board (PCB) by means of surface mounting (SMD technology). The feed terminal 15' is for this purpose soldered to a suitable strip conductor of the printed circuit board, via which conductor the electromagnetic energy to be radiated is supplied. The ground metallization 12' may be soldered to a ground connection of the printed circuit board via a metallization feed terminal (not shown) on the first substrate 11'.

A further advantage of this embodiment is that the geometries of the ground metallizations 23, 33 of the patch resonators 20, 30 can remain substantially unchanged, in contrast to resonant couplings by means of known gap resonators. This implies a substantial simplification in the design of multilayer patch antennas, in particular of such antennas with short-circuit conductors.

The following values were preferably chosen in a realization of this antenna. the dimensions of the second and the third substrate 21, 31 are each approximately 19.0×10.5×2.0 $mm^3$. The dimensions of the first substrate 11 are approximately 19.0×10.5×1.0 $mm^3$. The dielectric properties are chosen approximately as follows: $\in_r$=18.55, tanδ=1.17×$10^{-4}$. This corresponds to the high-frequency properties of a commercially available NP0-K17 ceramic ($Ca_{0.05}mG_{0.95}TiO_3$ ceramic). The conductivity of the metallizations was chosen to be approximately s=3.0×$10^7$ S/m (silver paste). The two patch patterns 13, 23 have dimensions of approximately 17.0×8.5 $mm^2$. The short-circuit conductor has a diameter of approximately 0.5 mm and a distance of approximately 2.4 mm in both lateral directions from respective corners of the patch patterns and extends through the three layers 10, 20, 30. The ground metallization 12 has a length of approximately 18.5 mm and a width of approximately 10.5 mm. The microstrip resonator (strip width approximately 0.36 mm) extends in a meandering shape below the ground metallization 12' on a NP0-K17 substrate with a height of approximately 1.0 mm. The vertical end of this resonator first has a width of approximately 0.36 mm over a length of approximately 1.0 mm and then a width of approximately 1.4 mm over a length of approximately 1.8 mm. The total length of the microstrip line is accordingly approximately 42.93 mm.

The distance between the start of the microstrip conductor 18' and the feed terminal 15', which is present in an U-shape around the former, is approximately 0.18 mm on all sides.

Figure 4:
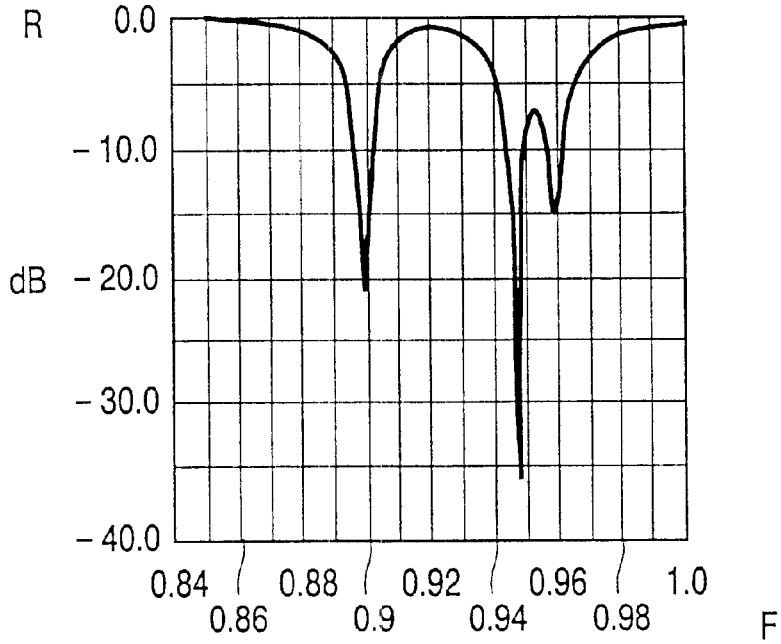
Figure 3:
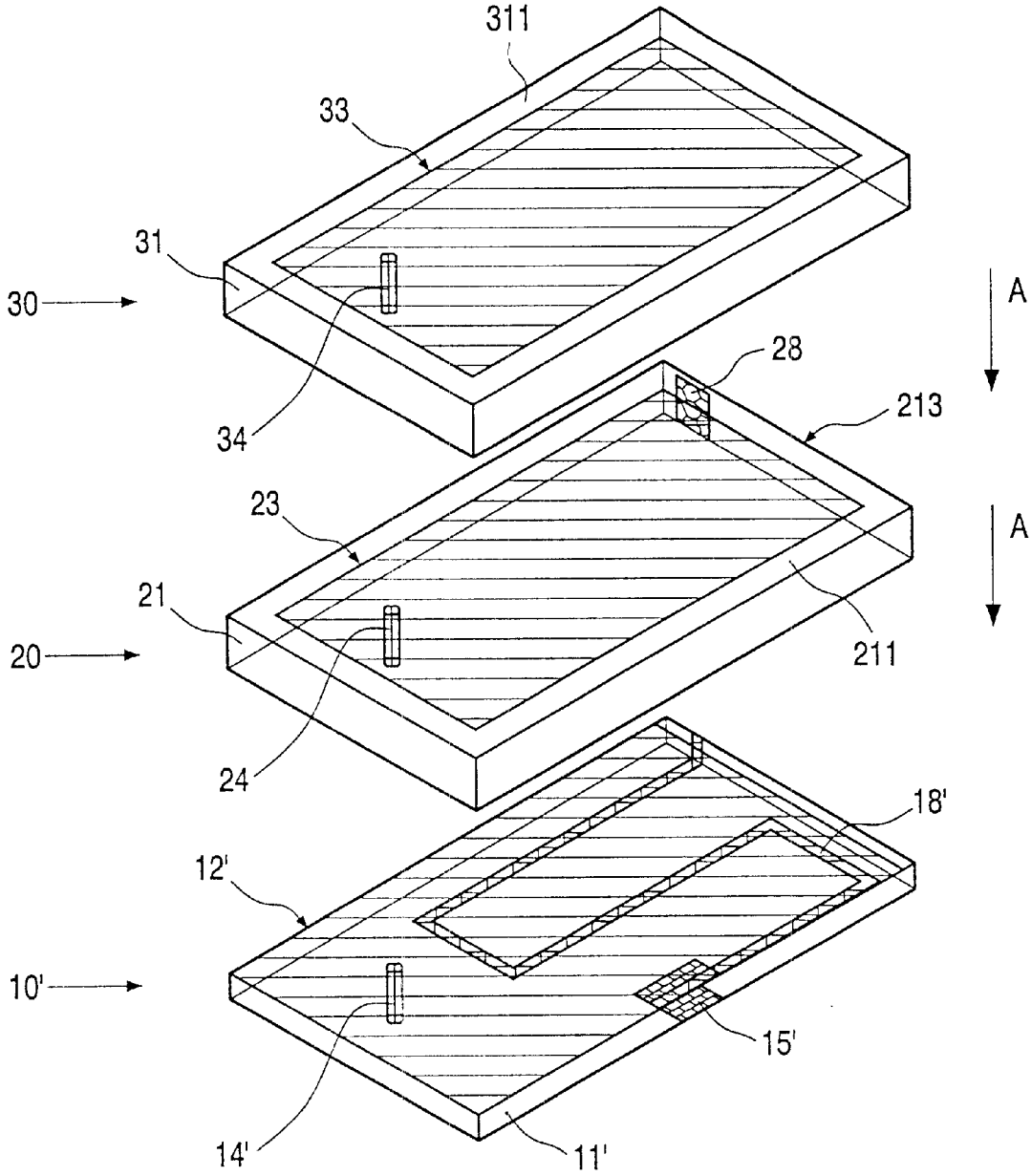
FIG. 3 shows a second embodiment of an antenna according to the invention which is composed of a microstrip resonator 10' with a first and a second patch resonator 20, 30 arranged thereon.

FIG. 4 is a diagram showing the gradient of the reflection properties, i.e. the ratio R [dB] between the power reflected at the antenna structure and the power supplied to the antenna as a function of the frequency F [GHz]. Three resonances can be clearly distinguished, which contribute to a widening of the total bandwidth of the antenna. The central resonance here is caused by the microstrip resonator, the other two resonances by the patch resonators.

Figure 5:
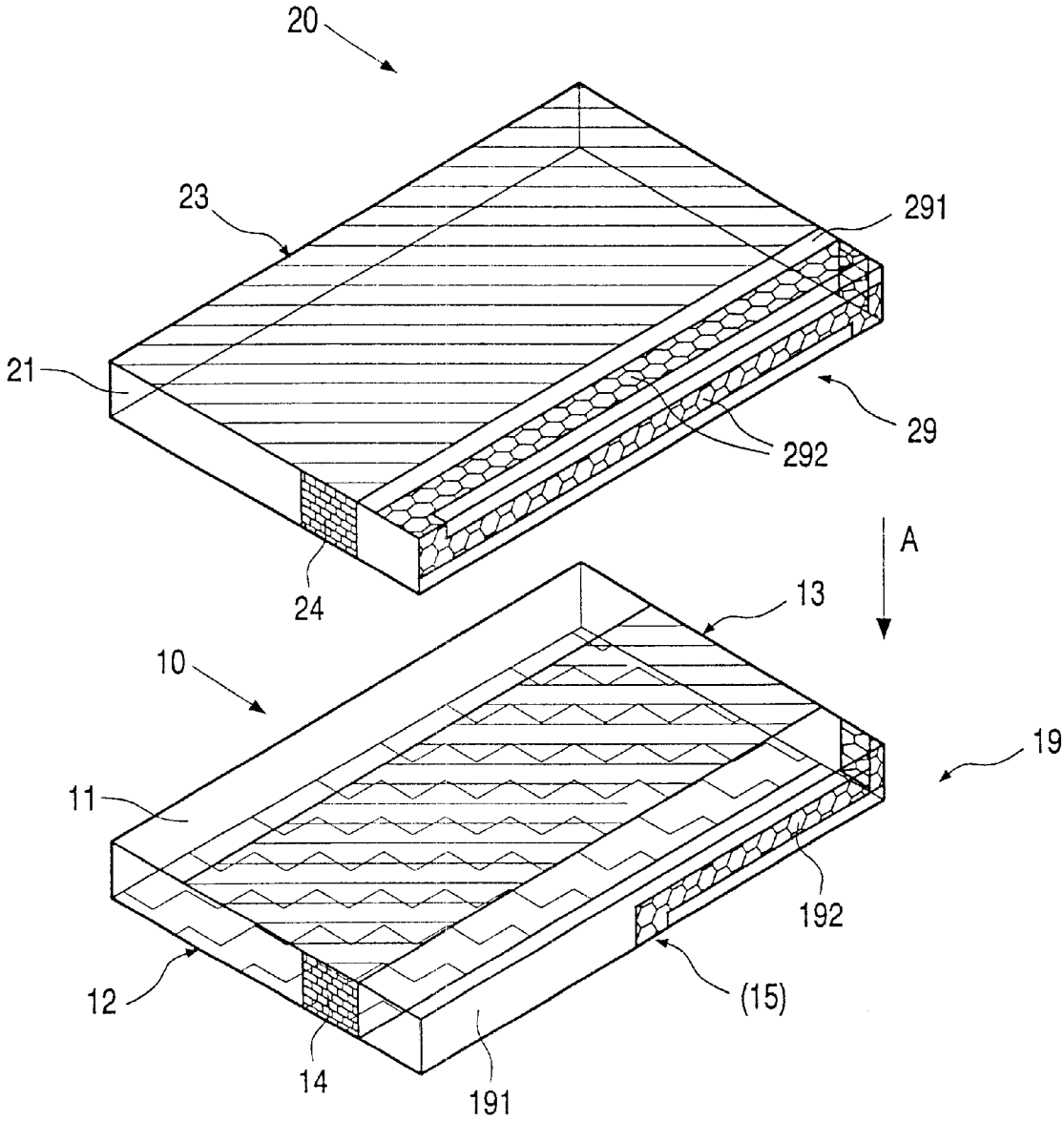

FIG. 5 shows a third embodiment of an antenna according to the invention which differs essentially from the second embodiment in that the resonant coupling of the electromagnetic energy does not take place by means of a microstrip resonator 10' but by means of a resonator formed by a so-called printed wire antenna ("printed wire resonator") 19, 29, the type here being that of a wire antenna resonator which is formed by a substrate of the kind mentioned above with a printed conductor track 192, 292.

The conductor track 192, 292 is electrically connected to the signal conductor of a feed terminal 15 and is capable of radiating energy in the form of waves upon reaching of an electromagnetic resonance. The values of the resonance frequencies are dependent on the dimensions of the printed conductor track and the dielectric or permeability value of the substrate, as is generally known.

A first patch resonator 10 is formed by a first substrate 11 on whose lower surface a ground metallization 12 is provided. A first pattern of metal patches 13 is present on a portion of the upper surface of the first substrate 11 so as to extend in longitudinal direction of the substrate 11. Parallel thereto, along a side face of the first substrate 11, a first portion 19 of the resonator is arranged, which is formed by a first edge portion 191 of the first substrate 11 with a first conductor track portion 192 printed thereon. The conductor track portion is connected to a feed terminal 15 at the lower surface of the substrate 11, which feed terminal is soldered to a corresponding supply conductor for electromagnetic energy during surface mounting of the antenna. In addition, a first portion 14 of a planar short-circuit conductor is arranged along another side face of the substrate 11.

A second patch resonator 20 is formed by a second substrate 21 on whose upper surface a second pattern of metal patches 23 is provided. A second resonator portion 29 corresponding to the first portion 19 of the resonator is provided along a side face of the second substrate 21 and is formed by a second edge region 291 of the second substrate 21 with a second conductor track portion 292 printed thereon. Finally, a second portion 24 of the planar short-circuit conductor is arranged along another side face of the second substrate 21, continuing the first portion 14 in the assembled state of the antenna and thus forming the short-circuit conductor.

When the two layers are joined together along arrow A, furthermore, the two conductor track portions 192, 292 complement one another so as to form a joint conductor track which runs in a meandering shape along the sides and a portion of the surfaces of the substrates and which is excited into resonance upon the supply of electromagnetic energy. In conjunction with the resonances of the patch resonators 10, 20 excited thereby, which resonances are somewhat different from one another because of the different surface areas of the patterns of metal patches 13, 23, a comparatively great bandwidth of the patch antenna similar to that shown in the picture of FIG. 4 is achieved. The electromagnetic coupling to the patch resonators 20, 30 again takes place via the stray fields of the printed wire resonator 19, 29.

This third embodiment in addition has substantially the same advantages as described with reference to the second embodiment.

The adaptation of the patch antennas described above to a concrete constructional situation as regards their resonance frequencies and their input impedance may be achieved through changing of the pattern of metal patches, of the metal structures serving for coupling, or of the gap between the feed terminal and the microstrip line by means of a laser beam (laser trimming).

The patch antennas according to the invention are particularly suitable for use in mobile telephones (besides the DECT and Bluetooth bands), because they combine small dimensions with a sufficient bandwidth for the GSM and UMTS bands, and at the same time can be provided together with other electronic components on a printed circuit board by means of surface mounting (SMD technology).

What is claimed is:

1. A patch antenna, comprising:

a first patch resonator (20; 30) including a first substrate (21; 31), and a first metal patch pattern (23; 33) formed on an interior of said first substrate (21; 31); and a second patch resonator (10; 20) including a second substrate (11; 21), and a second metal patch pattern (13; 23) formed on an interior of said second substrate (11; 21)

wherein said first substrate (21; 31) lies on said second metal patch pattern (13; 23).

2. The patch antenna of claim 1, wherein a first surface of said first substrate (21; 31) lies on said second metal patch pattern (13; 23); and wherein said first metal patch pattern (23; 33) is formed on a second surface of said first substrate (21; 31).

3. The patch antenna of claim 1, wherein said first patch resonator (20; 30) further includes a first short circuit conductor (24; 34) for coupling said first metal patch pattern (23; 33) and said second metal patch pattern (13; 23).

4. The patch antenna of claim 1, wherein said first short circuit conductor (24) is formed within an exterior said first substrate (21).

5. The patch antenna of claim 1, wherein said first short circuit conductor (24; 34) is formed on said interior of said first substrate (21; 31).

6. The patch antenna of claim 1, wherein said second patch resonator (10) further includes a ground metallization (12) formed on said interior of said second substrate (11).

7. The patch antenna of claim 6, wherein said second patch resonator (10) further includes a second short circuit conductor (14) for coupling said ground metallization (12) and said second metal patch pattern (13).

8. The patch antenna of claim 7, wherein said second short circuit conductor (14) is formed within an exterior said second substrate (11).

9. The patch antenna of claim 7, wherein said second short circuit conductor (14) is formed on said interior of said second substrate (11).

10. The patch antenna of claim 6, wherein said second patch resonator (10) further includes a feed terminal (15, 17) insulated from said ground metallization (12).

11. The patch antenna of claim 1, further comprising:

a microstrip resonator (10')including a third substrate (11'), and a ground metallization (12') formed on an interior of said third substrate (10').

12. The patch antenna of claim 11, wherein said second substrate (21) lies on said third substrate (11').

13. The patch antenna of claim 11, wherein said second patch resonator (20) further includes a second short circuit conductor (24) for coupling said second metal patch pattern (23) and said ground metallization (12').

14. The patch antenna of claim 13, wherein said second substrate (21) lies on said ground metallization (12').

15. The patch antenna of claim 11, wherein said microstrip resonator (10') further includes a feed terminal (15') formed on an interior of said third substrate (11').

16. The patch antenna of claim 15, further comprising:

a microstrip conductor (18') formed on said interior of said second substrate (21) and said interior of said third substrate (11'), said microstrip conductor (18') operable to be coupled to said feed terminal (15').

17. The patch antenna of claim 11, further comprising:

a microstrip conductor (18') formed on said interior of said second substrate (21) and said interior of said third substrate (11').

18. The patch antenna of claim 1, further comprising:

a printed wire resonator (19, 29) formed on said interior of said first substrate (21) and on said interior of said second substrate (11).

19. The patch antenna of claim 18, wherein said second substrate (11) further includes a feed terminal (15) formed on said interior of said second substrate (11), said feed terminal (15) operable to coupled to said printed wire resonator (19, 29).

20. The patch antenna of claim 8, wherein said printed wire resonator (19, 29) is operable to be coupled to said first metal patch pattern (23) and to said second metal patch pattern (13).

* * * * *